US010066448B2

(12) United States Patent
Parkin et al.

(10) Patent No.: US 10,066,448 B2
(45) Date of Patent: Sep. 4, 2018

(54) DOWNHOLE STEERING SYSTEM

(71) Applicant: Schlumberger Technology Corporation, Sugar land, TX (US)

(72) Inventors: Edward George Parkin, Cheltenham (GB); Steven Hough, Minchinhampton (GB); Miguel Marcel Jose Delgado, Bristol (GB); Junichi Sugiura, Bristol (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 337 days.

(21) Appl. No.: 14/838,315

(22) Filed: Aug. 27, 2015

(65) Prior Publication Data

US 2016/0060960 A1 Mar. 3, 2016

Related U.S. Application Data

(60) Provisional application No. 62/042,883, filed on Aug. 28, 2014.

(51) Int. Cl.
*E21B 7/06* (2006.01)
*E21B 17/10* (2006.01)

(52) U.S. Cl.
CPC ..... *E21B 17/10* (2013.01); *E21B 7/062* (2013.01)

(58) Field of Classification Search
None
See application file for complete search history.

(56) References Cited

U.S. PATENT DOCUMENTS 3,370,657 A * 2/1968 Antle ..... E21B 7/062 175/230
4,305,474 A 12/1981 Farris et al.
6,109,372 A * 8/2000 Dorel ..... E21B 7/06 175/269

(Continued)

FOREIGN PATENT DOCUMENTS

WO 2009002996 A1 12/2008

OTHER PUBLICATIONS

International Search Report and Written Opinion issued in related International Application No. PCT/US2015/047319 dated Nov. 4, 2015 (13 pages).

*Primary Examiner* — Shane Bomar

(57) ABSTRACT

A technique facilitates drilling of deviated boreholes. The technique employs a drilling system which may be disposed along a drill string. The drilling system may be used to drill a straight section of a borehole along a straight borehole axis and to also selectively drill a deviated section of the borehole. The drilling system comprises a housing, a bit shaft rotatably mounted in the housing, and an actuator which may be selectively actuated to shift the bit shaft to another position with respect to the straight borehole axis. The actuator is selectively shiftable between an unbiased mode and a biased mode. In the unbiased mode, the bit shaft axis is in a first position with respect to the straight borehole axis during drilling of the straight section of borehole. The actuator may be selectively shifted to the biased mode in which the bit shaft axis is shifted off axis relative to the straight borehole axis to enable drilling of the desired deviated section of the borehole.

17 Claims, 8 Drawing Sheets

(56) References Cited

U.S. PATENT DOCUMENTS

| | | | | |
|---|---|---|---|---|
| 6,427,783 | B2 * | 8/2002 | Krueger | E21B 7/062 175/325.3 |
| 6,595,303 | B2 | 7/2003 | Noe et al. | |
| 7,866,415 | B2 | 1/2011 | Peters | |
| 8,936,099 | B2 | 1/2015 | Hu | |
| 2010/0108382 | A1 * | 5/2010 | Ma | E21B 7/06 175/24 |
| 2011/0266063 | A1 | 11/2011 | Downton | |
| 2015/0136490 | A1 * | 5/2015 | Broussard, Jr. | E21B 25/00 175/57 |

* cited by examiner

DOWNHOLE STEERING SYSTEM

CROSS-REFERENCE TO RELATED APPLICATION

The present document is based on and claims priority to U.S. Provisional Application Ser. No. 62/042,883, filed Aug. 28, 2014, which is incorporated herein by reference in its entirety.

BACKGROUND

Controlled directional drilling has been used to improve access to a variety of hydrocarbon reservoirs. Directional drilling enables the drilling of a deviated borehole. Various techniques have been employed to facilitate drilling of a borehole along a desired deviated trajectory, including techniques using rotary steerable drilling systems and bent housing motors. A bent housing motor configuration includes a positive displacement motor, such as a mud motor, and a bent sub or housing to provide steering capability and directional control. The bent sub or bent housing orients the drill bit in a deviated direction compared to the remainder of the drill string. While the drill string is rotating, the bent housing rotates with the drill bit of the drilling system and enables drilling of a generally straight borehole. To provide a deviated trajectory, the drill string is rotated until the bent housing is oriented in the direction in which the driller would like the borehole to extend. The drill string is then held rotationally stationary and the drill bit is rotated by, for example, pumping fluid through the drill string to rotate a mud motor coupled with the drill bit. This allows the continued drilling of the deviated borehole by the drill bit as the drilling system deviates from the straight borehole in the direction of deviation established by the bent housing.

SUMMARY

In general, a system and methodology are provided for steering during drilling of a borehole. The system and methodology employ a drilling system which may be disposed along a drill string. The drilling system may be used to drill a straight section of a borehole along a straight borehole axis and to also selectively drill a deviated section of the borehole. The drilling system comprises a housing, a bit shaft rotatably mounted in the housing, and an actuator which may be selectively actuated to shift the bit shaft to another position with respect to the straight borehole axis. The actuator is selectively shiftable between an unbiased mode and a biased mode. In the unbiased mode, the bit shaft axis is in a first position relative to the straight borehole axis, e.g. a position aligned with the straight borehole axis, during drilling of the straight section of borehole. The actuator may be selectively shifted to the biased mode in which the bit shaft axis is shifted off axis relative to the straight borehole axis to enable drilling of the desired deviated section of the borehole. In some applications, the drill string is allowed to rotate during drilling of the straight sections of borehole and is held rotationally stationary during drilling of the deviated sections of borehole. In these types of applications, the drilling system may effectively be used as a selectively controllable bent housing.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
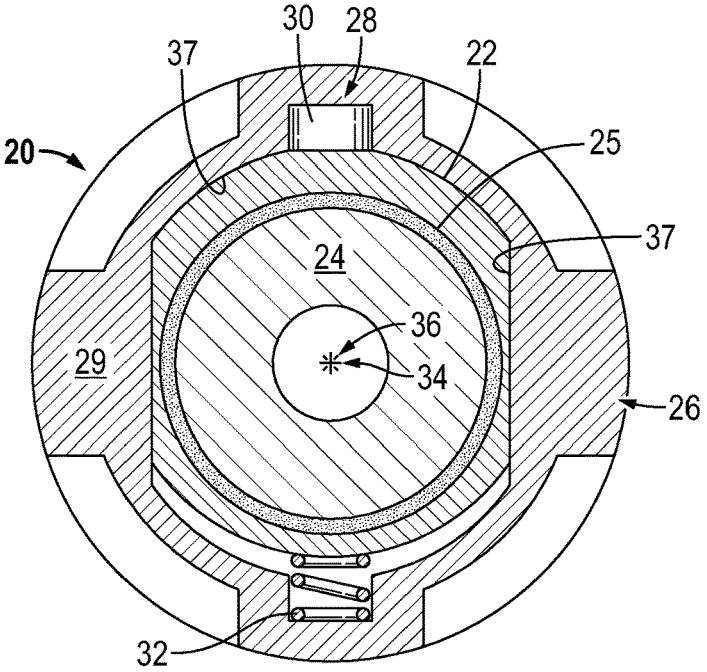
FIG. 1 is a cross-sectional illustration of an example of a drilling system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate drilling of deviated boreholes. According to an embodiment of the technique, an actuator may be selectively operated to shift a bit shaft axis out of alignment with a primary axis, such as an axis of a straight section of borehole. In some applications, the actuator may be used in combination with a stabilizer rather than employing a traditional bent sub or bent housing mud motor system. According to an embodiment, a bearing housing is combined with a bit shaft rotatably mounted in the bearing housing. By way of example, the bearing housing may be part of a positive displacement motor. A structure, e.g. a stabilizer, may be mounted around the bearing housing and an actuator is engaged with the structure. The actuator may be positioned between the bearing housing and the structure, e.g. stabilizer, to shift the bearing housing, and thus the bit shaft axis, laterally with respect to the primary axis.

In some embodiments, the drill string and/or drill shaft may be effectively bent by the actuator to enable deviated drilling as the drill bit is rotated while the drill string remains stationary. Depending on the application, the actuator may be engaged with the stabilizer and may be in the form of a movable stabilizer blade or other laterally movable feature coupled with the stabilizer. Regardless of the specific construction, the actuator is oriented to enable selective shifting of the bit shaft off axis (with respect to the primary axis, e.g. the straight drilling borehole trajectory axis) to facilitate transition between straight drilling and deviated drilling.

Depending on the drilling application, the technique described herein may be employed with either a push-the-bit type steering system or a point-the-bit type steering system. In embodiments using point-the-bit type steering systems, the actuator may be positioned to act against another drilling system component, e.g. a sleeve. However, in push-the-bit type steering systems, the actuator may be positioned to act against a surrounding wellbore wall.

In a variety of applications, the drilling system described herein enables decoupling of a steering actuator speed and a drill bit speed. In an embodiment, an actuatable stabilizer is mounted on a bearing housing, e.g. a bearing housing of a positive displacement motor. The bearing housing is automatically pushed to one side when the positive displacement motor is in sliding mode, i.e. directional drilling mode. As a result, the system in this type of embodiment behaves like a push-the-bit steering system. However, the present drilling system is able to automatically activate the push force when the positive displacement motor is to drill directionally in sliding mode. When the motor is in rotary mode, the push force is not activated so that the drilling system may drill in a straight direction. Embodiments of the drilling system described herein can be used to drill vertical borehole sections, high dog leg severity (DLS) curves, and lateral borehole sections in a single trip with very little cost increase over a standard motor. It should be noted that a point-the-bit steering system can be constructed by, for example, placing a fixed stabilizer between the actuatable stabilizer and the drill bit.

In certain embodiments, the drill string may be continually rotated during drilling of a straight section of borehole. While drilling the straight borehole section, the actuator remains in an un-actuated or neutral state, e.g. an unbiased mode, so there is no lateral push force established. In this unbiased mode, the drill shaft/bit axis remains in an unbiased position with respect to a primary axis which may be the axis of a straight section of borehole. The straight borehole axis may be the same axis as that of the portion of the drill string extending concentrically along the straight section of borehole. By way of example, the unbiased position of the drill bit axis may be a position generally aligned with the primary axis.

When a deviated section of the borehole is to be drilled, the drill string is rotated to a desired rotational orientation and the actuator is transitioned to apply a sideload which may be used to apply a lateral push force on the drill bit. This actuation effectively shifts the actuator to a biased mode and moves the drill shaft/bit axis to a new position with respect to the primary axis. For example, the drill bit axis may be moved out of general alignment with respect to the primary axis, i.e. moved off axis with respect to the primary axis, to enable drilling of a deviated borehole section along a desired trajectory. When shifted to the biased mode, the drill bit axis may be parallel to or at an angle with respect to the primary axis depending on the construction of the overall drilling system and on the parameters of a given application.

In some applications, actuation of the actuator, e.g. movement of the stabilizer, effectively creates a bend in the drill string which facilitates drilling of the deviated borehole section while the drill string remains rotationally stationary. While actuated to this biased mode, the drill bit is rotated via a bit shaft to drill the deviated borehole in the direction established by the rotational orientation of the drill string. If a straight section is again desired, the actuator may be shifted back to an unbiased mode in which the drill bit axis returns to its original position, e.g. a generally aligned position, with respect to the primary axis. This process may be repeated to drill the desired deviated and straight sections of a given borehole. Control over the deviated drilling can be initiated uphole, downhole, or both. It should be noted that in some applications the orientation of at least a portion of the drill string may be established by a downhole orienter rather than by rotating the entire drill string from the surface. Depending on the application, control over the pertinent portion of the tool string to establish a deviated drilling direction may be implemented at the surface, at a bottom hole assembly, or at an appropriate position there between.

Figure 2:
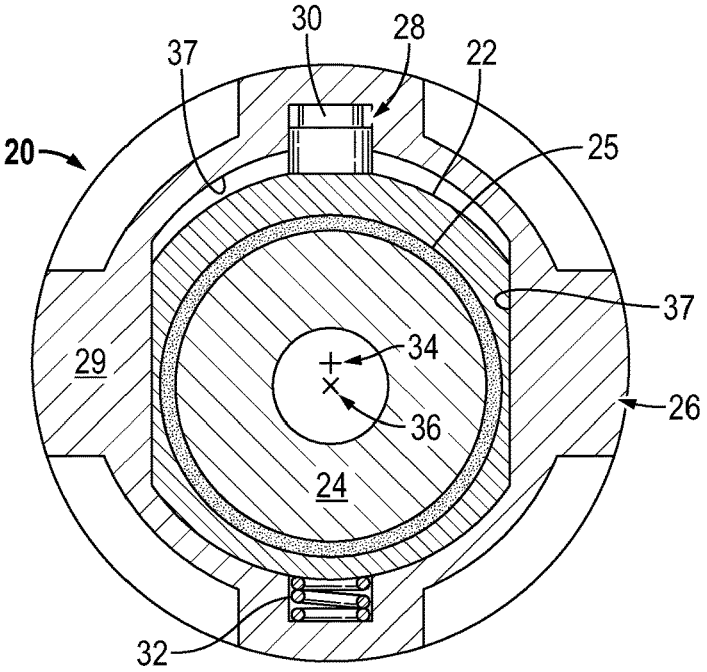
FIG. 2 is a cross-sectional illustration of the drilling system illustrated in FIG. 1 but in a different operational position, according to an embodiment of the disclosure.
Figure 3:
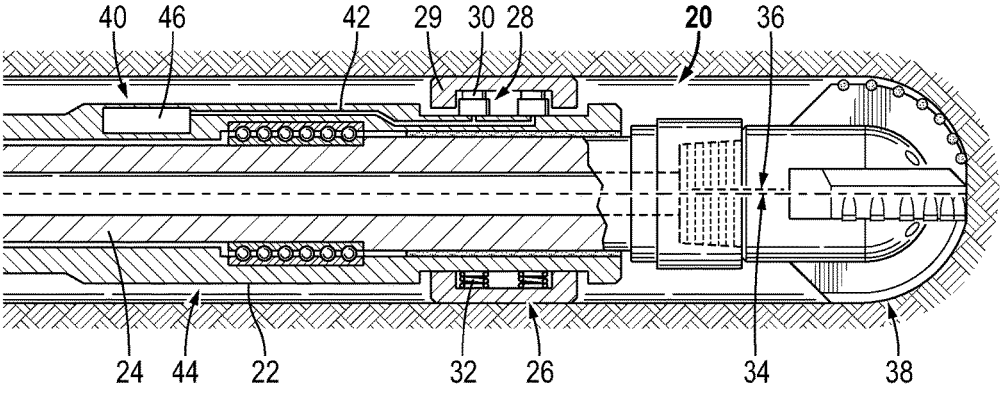
FIG. 3 is a cross-sectional illustration of an example of the drilling system taken along a longitudinal axis of the drilling system, according to an embodiment of the disclosure.

Referring generally to FIGS. 1-3, an example of a downhole drilling system 20 is illustrated in various cross-sectional views. The embodiment illustrated in FIGS. 1-3 provides an initial example of drilling system 20 which may be selectively shifted between an unbiased mode for drilling of straight sections of borehole and a biased mode for drilling of desired deviated sections of borehole. In the biased mode, a drilling axis is selectively shifted or transitioned to a new orientation with respect to a primary axis. The primary axis may be defined as the axis of the straight section of borehole from which the drilling direction is to deviate. Thus, the primary axis is a central axis extending longitudinally along the straight section of borehole and along the drill string concentrically located in the straight section of borehole leading to the deviated section to be drilled. As described in greater detail below, various embodiments of an actuator may be employed to enable selective transition of the drill shaft/bit axis to a new position relative to the primary axis when drilling deviated sections of the borehole (see, for example, FIGS. 12-14). The drilling system 20 may be used to drill a deviated borehole along a desired drilling trajectory while the drill string is held rotationally stationary. The drilling system 20 may be combined with a variety of drill strings and bottom hole assemblies for drilling of desired boreholes.

In the embodiment illustrated in FIGS. 1-3, drilling system 20 comprises a housing 22, e.g. a bearing housing of a positive displacement motor. A drive shaft 24 is rotatably mounted within the housing 22 via, for example, a radial bearing 25. For example, drive shaft 24 may comprise a bit shaft for rotating a drill bit. An actuator structure 26, e.g. a stabilizer, is mounted around the housing 22 and an actuator 28 is engaged with the structure 26. The structure 26 may comprise a ring 29 or other suitable component which surrounds at least a portion of the housing 22. In this example, the actuator 28 is disposed between the bearing housing 22 and the structure 26 and may comprise a piston 30. Additionally, a spring 32 may be positioned between the bearing housing 22 and the stabilizer 26 in a manner which provides a bias against shifting of the shaft 24 off a primary axis 34. The primary axis 34 may be a central axis of a straight section of the borehole being drilled along a straight drilling trajectory prior to forming deviated sections of the borehole. During drilling of straight sections of borehole, a drill shaft/bit axis 36 of the shaft 24 is located at an unbiased position (i.e. drilling system 20 is in the unbiased mode) with respect to the primary axis 34, e.g. the straight drilling axis along the straight section of borehole prior to deviation.

In some applications, the drill string may be rotated during drilling of the straight sections of borehole while the structure 26 remains in the unbiased mode and the drill shaft/bit axis 36 remains in the unbiased position, e.g. generally aligned with primary axis 34. Spring 32 holds the stabilizer 26 and the bearing housing 22 such that axis 36 is sufficiently aligned with primary axis 34 so that the positive displacement motor housing 22 has a neutral tendency to enable drilling straight. Rotational degrees of freedom between the structure 26 and the bearing housing 22 are controlled, e.g. restricted, by sections 37 of the housing including flat sections 37.

In the illustration of FIG. 2, the actuator 28 has been actuated, e.g. the piston 30 has been actuated hydraulically and shifted to an extended position. The actuation of piston 30 transitions the drilling system 20 to the biased mode by pushing the drill shaft/bit axis 36 to a new position with respect to the primary axis 34. In this example, the bit shaft 24 has been pushed off axis with respect to the straight borehole drilling axis 34. This movement provides a side force which acts on a drill bit 38 to initiate a deviated or directional drilling, as illustrated in FIG. 3. By way of further explanation, the movement causes the bearing housing 22 to be re-oriented relative to the borehole that has been drilled, e.g. relative to primary axis 34 (or relative to another reference, e.g. a gravity or magnetic reference), so that the drilling structure is pointed in the desired direction (toolface) causing the drill bit 38 to drill in the desired direction. As described above, actuation of structure 26 may effectively create a bent section of the drill string to facilitate drilling of desired, deviated sections of the borehole.

With further reference to FIG. 3, a control system 40, e.g. a hydraulic pump and control system, may be used to selectively supply hydraulic fluid to piston 30 (or pistons 30) via a hydraulic channel 42. By way of example, the control system 40 may be positioned in bearing housing 22 of a positive displacement motor 44 or at another suitable location. In some embodiments, the entire oil system can be sealed using bellows at the control system 40 and at the piston 30 to avoid leakage of hydraulic fluid, e.g. oil. The structure enables construction of a low-cost steering system having no or limited electronics and which can be operated without sensors and without communication to other tools.

Figure 4:
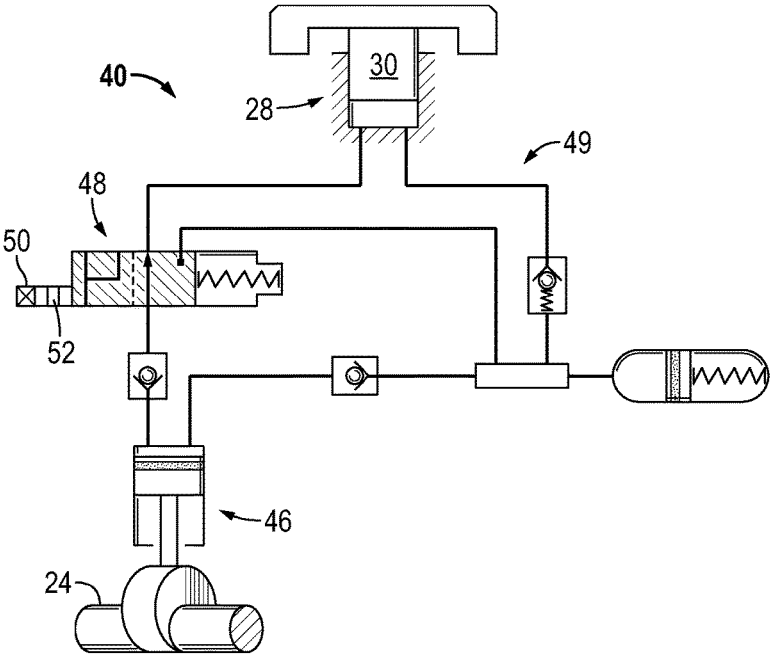
FIG. 4 is a schematic illustration of an example of a hydraulic circuit for controlling an actuator of the drilling system, according to an embodiment of the disclosure.

In this example, the actuator 28, e.g. piston or pistons 30, may be actuated automatically according to a variety of methods. For example, the control system 40 may be a system based on internally driven continuous hydraulics and electrical sensing, as illustrated diagrammatically in FIG. 4. In this example, a hydraulic pump 46 continuously pumps and provides pressurized oil when there is mud flow through motor 44. The hydraulic pump 46 may be powered by the rotation of drive/bit shaft 24. A valve 48 is positioned in a hydraulic circuit 49 and is used to control the flow of high pressure oil to the piston 30. A sensor 50, e.g. an electrically powered sensor, in combination with low-power electronics 52 can be used to detect rotation of the bearing housing 22 relative to gravity and to selectively actuate the valve 48. A small power source (e.g. a generator powered from shaft 24, a turbine, a small positive displacement motor linked to a generator, or other power sources) can be used to supply power to electronics 52 and electrical sensor 50.

Figure 5:
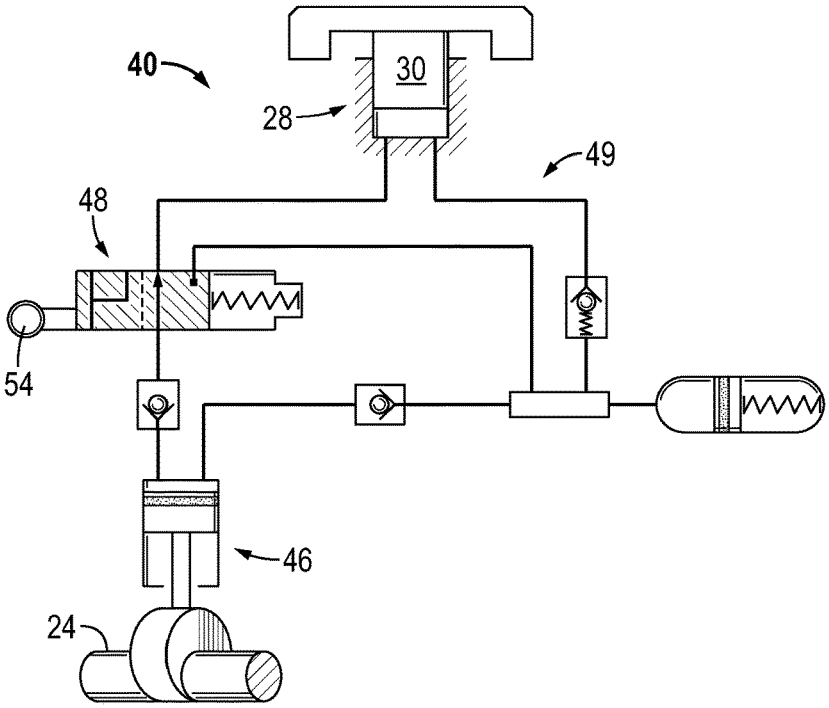
FIG. 5 is a schematic illustration of another example of a hydraulic circuit for controlling an actuator of the drilling system, according to an embodiment of the disclosure.

In another embodiment, the control system 40 may be a system based on internally driven continuous hydraulics and external mechanical sensing, as illustrated diagrammatically in FIG. 5. In this example, hydraulic pump 46 continuously pumps and provides pressurized oil when there is mud flow through motor 44. The hydraulic pump 46 may be powered by the rotation of drive/bit shaft 24. A non-rotating sleeve or external roller, e.g. a roller in a stabilizer blade, may be used as a mechanical sensor 54. Valve 48 is used to control the flow of high pressure oil to the piston 30. The valve 48 may be linked to the mechanical sensor/mechanism 54 so that the valve 48 opens when there is no rotation between the borehole and the bearing housing 22 and closes when there is rotation between the borehole and the bearing housing 22. In another example, the mechanical sensing is based on centrifugal forces associated with rotation of the bearing housing, and valve 48 may be opened when there is no rotation between the borehole and the bearing housing 22 and closed when there is rotation.

Figure 6:
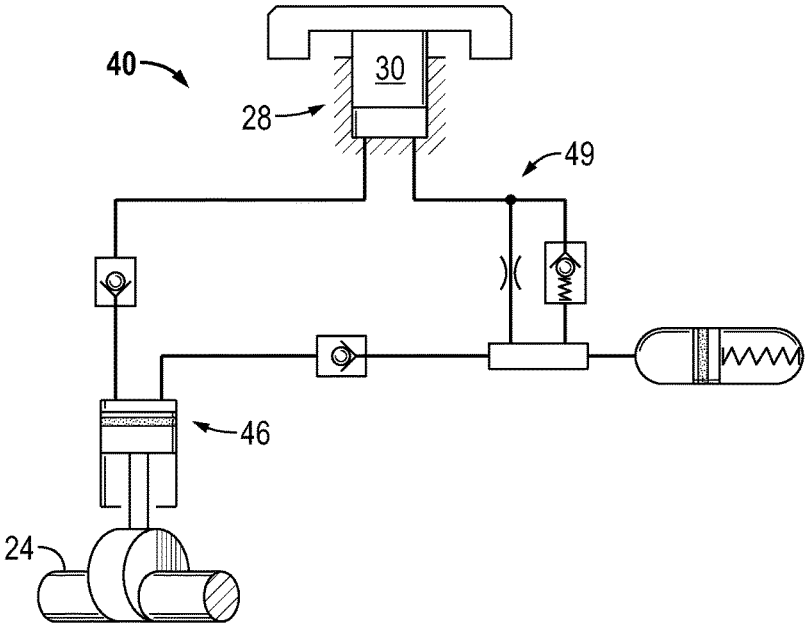
FIG. 6 is a schematic illustration of another example of a hydraulic circuit for controlling an actuator of the drilling system, according to an embodiment of the disclosure.

In another embodiment, the control system 40 may be a system based on externally driven non-continuous hydraulics and external mechanical sensing, as illustrated diagrammatically in FIG. 6. In this example, the mechanical sensor/mechanism may again be a non-rotating sleeve, external roller, or other suitable mechanism. The hydraulic pump 46 pumps and provides pressurized oil when there is relative rotation between the formation and the bearing housing 22. In this example, no valve is used for control because the control is automatic with rotation. Piston 30 is positioned on the locking side and a spring may be used for the activated push force.

Figure 7:
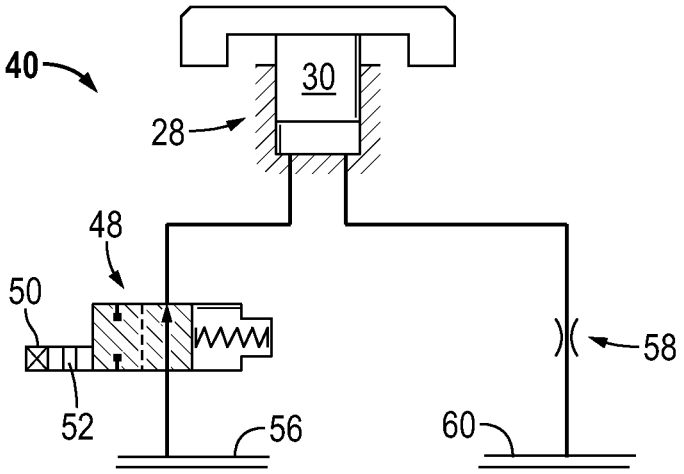
FIG. 7 is a schematic illustration of another example of a hydraulic circuit for controlling an actuator of the drilling system, according to an embodiment of the disclosure.

In another embodiment, the control system 40 may be a system based on internal mud pressure and electrical sensing, as illustrated diagrammatically in FIG. 7. In this example, the valve 48 is used to control the flow of high pressure mud from an internal mud flow channel 56 to the piston 30. The low-power electronics 52 can be used to detect rotation of the bearing housing 22 relative to gravity and to selectively actuate the valve 48. As described above, a small power source can be used to supply power to electronics 52. A choke 58 may be positioned to bleed the piston 30 to an annulus 60 of the wellbore.

Figure 8:
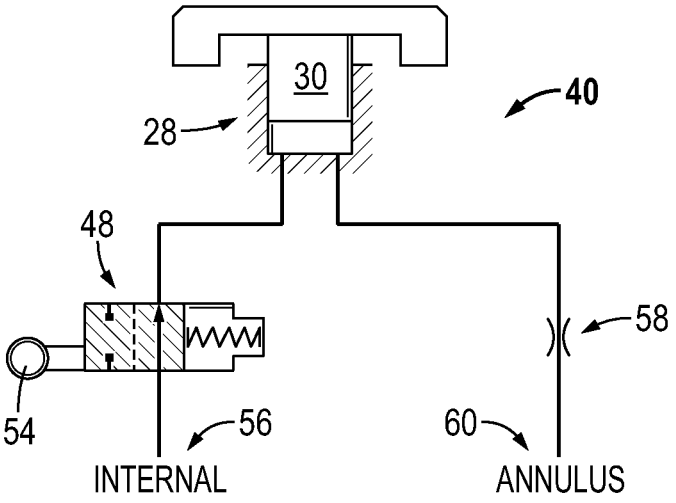
FIG. 8 is a schematic illustration of another example of a hydraulic circuit for controlling an actuator of the drilling system, according to an embodiment of the disclosure.

In another embodiment, the control system 40 may be a system based on internal mud pressure and mechanical sensing, as illustrated diagrammatically in FIG. 8. For example, the mechanical sensing may comprise external mechanical sensing. In this type of arrangement, the mechanical sensor 54 may comprise the non-rotating sleeve, external roller, or other suitable mechanism. Valve 48 controls the flow of high pressure mud from the internal channel 56 and is linked to the mechanism 54 so that the valve 48 opens when there is no rotation between the borehole and the bearing housing 22 and closes when there is rotation. Choke 58 may be used bleed the piston 30 to the annulus 60.

In a related embodiment, internal mechanical sensing is employed. In this example, valve 48 controls the flow of high pressure mud from the internal channel 56 to the piston 30 and uses the centrifugal forces of the rotation of the bearing housing 22. With this arrangement, the valve 48 opens when there is no rotation between the borehole and the bearing housing 22 and closes when there is rotation. Choke 58 may again be used to bleed the piston 30 to the annulus 60.

However, various additions and/or changes to the drilling system 20 and the hydraulic pump and control system 40 may be employed according to the parameters of a given application. For example, the actuator 28 may comprise a single pad with no stabilization when the pad is not activated. The actuator or actuators 28 also may comprise two active pads and two stabilization blades. In this example, the active pads move in opposite radial directions in the sense that one moves radially inwardly as a corresponding one moves radially outwardly. A second set of pistons may be used to replace springs 32, and the second set of pistons may be activated opposite to the primary pistons 30 to increase both pushing and locking forces. Additionally, valve 48 in the mud actuated systems can be linked to the mud fluid above an upper radial bearing of the motor 44 to provide a short channel for mud travel. The mud activated control systems 40 can be constructed to push a pressure amplification piston with oil. The pressure amplification piston may be located on an opposite side above the bearing section. In this latter example, a closed oil system may be positioned between the amplification piston and the main actuator pad piston to reduce the path length for mud to travel through the tool. Additionally, the drilling system 20 may be a point-the-bit type system which directs the drive shaft 24 rather than the overall drill string. In such a system, the axis 36 of the drive shaft 24 may be displaced at an angle with respect to the primary axis 34, e.g. with respect to the straight borehole drilling axis extending along a straight section of borehole.

Figure 9:
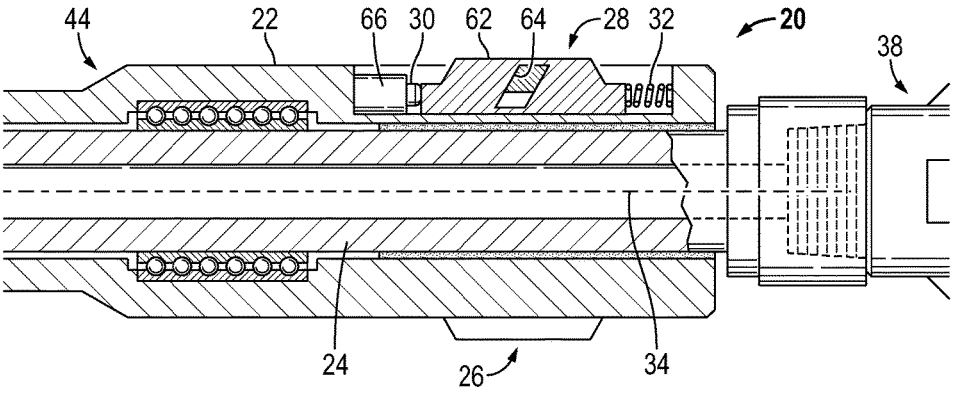
FIG. 9 is a cross-sectional illustration of another example of the drilling system taken along a longitudinal axis of the drilling system, according to an embodiment of the disclosure.
Figure 10:
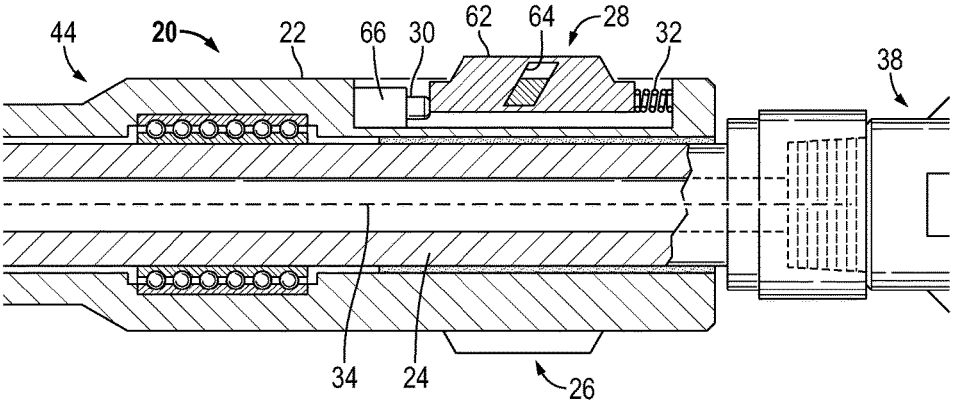
FIG. 10 is a cross-sectional illustration of the drilling system illustrated in FIG. 9 but in a different operational position, according to an embodiment of the disclosure.

Referring generally to FIGS. 9 and 10, another embodiment of drilling system 20 is illustrated. Generally, the illustrated embodiment provides a steerable motor with adjustable near-bit stabilizers. The extension of at least one blade of the near-bit stabilizer may be adjusted hydro-mechanically, mechanically, electrically, or by another suitable system. The adjusted outer diameter of the adjustable near-bit stabilizer may be as big as a bit diameter or larger while the tool is directionally steering (sliding mode). The steerable motor also may be modularized so that the power section may be suitably configured and/or changeable.

As illustrated in FIG. 9, the drilling system 20 comprises housing 22, e.g. a bearing housing, and shaft 24 rotatably received in the housing 22. In this example, structure 26 is in the form of a stabilizer mounted around the housing 22, and actuator 28 comprises a shiftable stabilizer blade 62 engaged with the stabilizer 26. In an example, the shiftable stabilizer blade 62 may be slidably mounted to housing 22 and/or stabilizer 26 via, for example, a track 64. In this example, the actuator 28 further comprises piston 30 which is reciprocated by a corresponding actuation mechanism 66, e.g. a hydraulic actuation mechanism. However, the actuation mechanism 66 may comprise a variety of other types of mechanisms, including hydro-mechanical mechanisms, electro-mechanical mechanisms, electric motors, drilling mud systems, and other types of mechanisms for moving the shiftable stabilizer blade 62 along track 64. By way of example, the mechanism 66 may be controlled to shift piston 30 in a manner which moves shiftable stabilizer blade 62 between a retracted position, as illustrated in FIG. 9, and an extended position, as illustrated in FIG. 10. Spring 32 may be positioned as illustrated to resist movement of the stabilizer blade 62 to the extended position.

Figure 11:
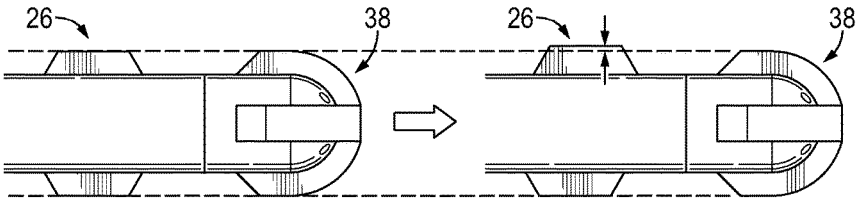
FIG. 11 is a schematic illustration of an example of a drilling system having a one-blade actuator stabilizer, according to an embodiment of the disclosure.

Directional drilling may be achieved when the drilling system 20 is in a slide drilling mode in which at least one shiftable stabilizer blade 62 of stabilizer 26 is extended to shift the housing 22 and drill bit 38 off axis, e.g. off the straight drilling axis 34 as described above. According to an example, the drill string may be rotated to a desired rotational orientation to enable drilling in a desired direction and then the stabilizer blade 62 may be shifted to enable deviated drilling in the desired direction by rotating drill bit shaft 24 and the corresponding drill bit while the drill string remains stationary. In a drill string rotating mode, the drilling system 20 enables drilling along a generally straight trajectory by shifting the adjustable stabilizer blade(s) 62 to an unactuated position, e.g. a neutral position slightly under gauge to avoid application of a lateral force. When in the slide mode or directional drilling mode, the outside diameter of the structure 26 is equal to or larger than the diameter of drill bit 38. An illustration of the shift from the neutral, rotating mode to the slide/directional drilling mode is illustrated schematically in FIG. 11. Depending on the application, the positive displacement motor 44 and/or the overall drilling system 20 may be modularized, and a steering head may be attached to sections of the motor 44.

Figure 12:
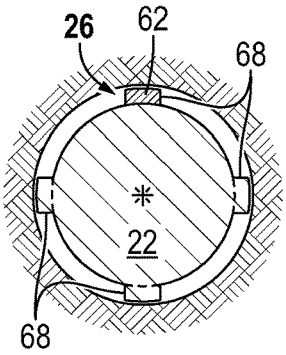
FIG. 12 is a schematic illustration of a drilling system having an actuator in the form of an adjustable stabilizer blade in a retracted position, according to an embodiment of the disclosure.
Figure 13:
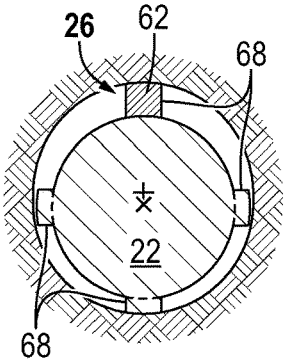
FIG. 13 is a schematic illustration of a drilling system having a stabilizer with an adjustable blade in an extended or biased position, according to an embodiment of the disclosure.
Figure 14:
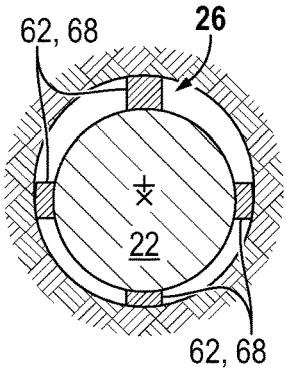
FIG. 14 is a schematic illustration of a drilling system having a stabilizer with a plurality of adjustable blades, according to an embodiment of the disclosure.

Referring generally to FIGS. 12-14, examples are provided in which the structure 26 is shiftable to move the shaft/bit axis 36 with respect to the straight drilling axis 34 so as to change a drilling direction. In FIG. 12, the bit/drive shaft axis and the primary axis, e.g. straight borehole axis, are aligned or in an unbiased relationship. In FIGS. 13-14, the bit/drive shaft axis has been shifted or biased with respect to the primary axis to cause drilling along a deviated (non-straight) trajectory.

By way of example, structure 26 may comprise a stabilizer having stabilizer blades 68 placed substantially equally-angularly around a lower and of the mud motor housing 22. By way of example, the number of stabilizer blades 68 may be from 3 to 5 blades although other numbers of blades 68 may be used in some applications. At least one of the blades 68 comprises the shiftable stabilizer blade 62 and the other blades 68 may be fixed. The fixed blades are used to make operation in sliding mode and tool face control easier, but other arrangements of fixed and shiftable blades 68 may be employed.

In the example illustrated in FIG. 12, the structure, e.g. stabilizer, 26 comprises four stabilizer blades 68 and one of those blades 68 is the shiftable stabilizer blade 62 while the other three blades 68 remaining in a retracted position. The tool is constructed so that the four stabilizer blades 68 have a neutral, unbiased position in which the blades 68 extend an equal distance to an under gauge position, as illustrated in FIG. 12. The tool also enables operation in at least one eccentric position in which the shiftable stabilizer blade 62 is in an extended, biased position for sliding mode, thus enabling directional drilling, as illustrated in FIG. 13. It should be noted, however, that additional stabilizer blades 68 or each of the stabilizer blades 68 may be formed as shiftable stabilizer blades 62, as in the embodiment illustrated in FIG. 14. In some embodiments, the movement of shiftable stabilizer blade 62 may be controlled via control system 40, e.g. a downhole automated control system.

Figure 15:
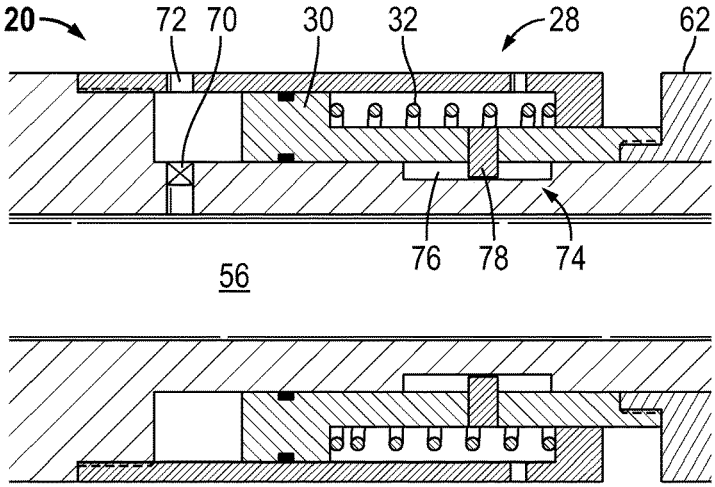
FIG. 15 is a cross-sectional illustration of a drilling system having an actuator in the form of a mud operated stabilizer blade, according to an embodiment of the disclosure.

Many systems and components for transitioning between the neutral mode and the sliding/directional drilling mode may be employed in drilling system 20. For example, adjustable stabilizer blades 62 may be positioned on a variety of tools and may be actuated via various internal hydraulic circuits. In some applications, the outside diameter of the stabilizer 26 via the adjustable stabilizer blades 62 may be programmed via a pressure downlink sequence. The position of the stabilizer blades 62 can be confirmed via a suitable telemetry system, such as a mud pulse telemetry system. As illustrated in FIG. 15, for example, at least one shiftable stabilizer blade 62 may be operated with mud pressure from mud flowing along internal mud flow channel 56. The mud flow to actuate the shiftable stabilizer blade 62 can be controlled by a suitable mud valve 70 which is operated to selectively allow the pressurized mud to actuate the stabilizer blade 62 or other suitable type of actuator 28. A choke 72 may be used to bleed off pressure acting against piston 30.

Referring again to FIG. 15, some embodiments of drilling system 20 may incorporate a mechanical activation control system 74. According to an example, the mechanical activation control system 74 may comprise a cam track 76 which cooperates with a cam follower 78. By way of example, the cam track 76 may be formed in housing 22 or shaft 24 (depending on the design of the overall drilling system 20) and the cam follower 78 may be coupled with piston 30. However, the cam track 76 and cam follower 78 may be reversed or used in cooperation with other actuator components.

Figure 16:
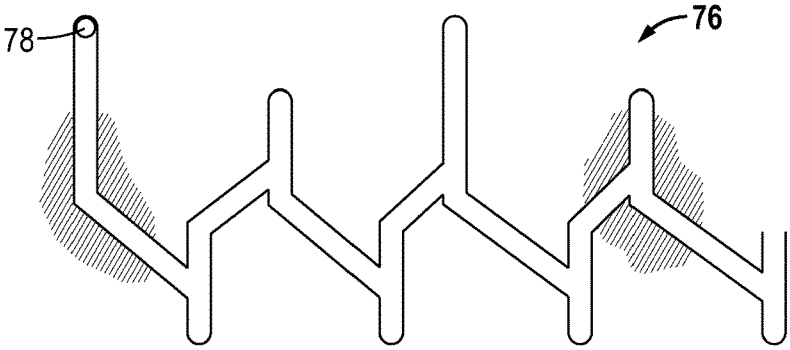
FIG. 16 is a schematic illustration of an example of a cam track which may be used to control an actuator during steering of a drilling assembly, according to an embodiment of the disclosure.

In FIG. 16, an example of cam track 76 is illustrated. In this example, the piston 30 is operated via fluid pressure, e.g fluid pressure from mud flow or from hydraulic pump 46, above or below normal operating pressure. By way of example, the fluid pressure may be used against piston 30 to compress spring 32 which indexes the mechanical activation control system 74 to a subsequent location. The spring 32 locates the next axial position by moving cam follower 78 along cam track 76 once the pressure returns to a normal operating value. In the example illustrated in FIG. 16, the shiftable stabilizer blade 62 (or other type of actuator) is shifted between two positions, e.g. a neutral position and a bias position, and this position is alternated each time the piston 30 is pressurized and moved against spring 32.

Figure 17:
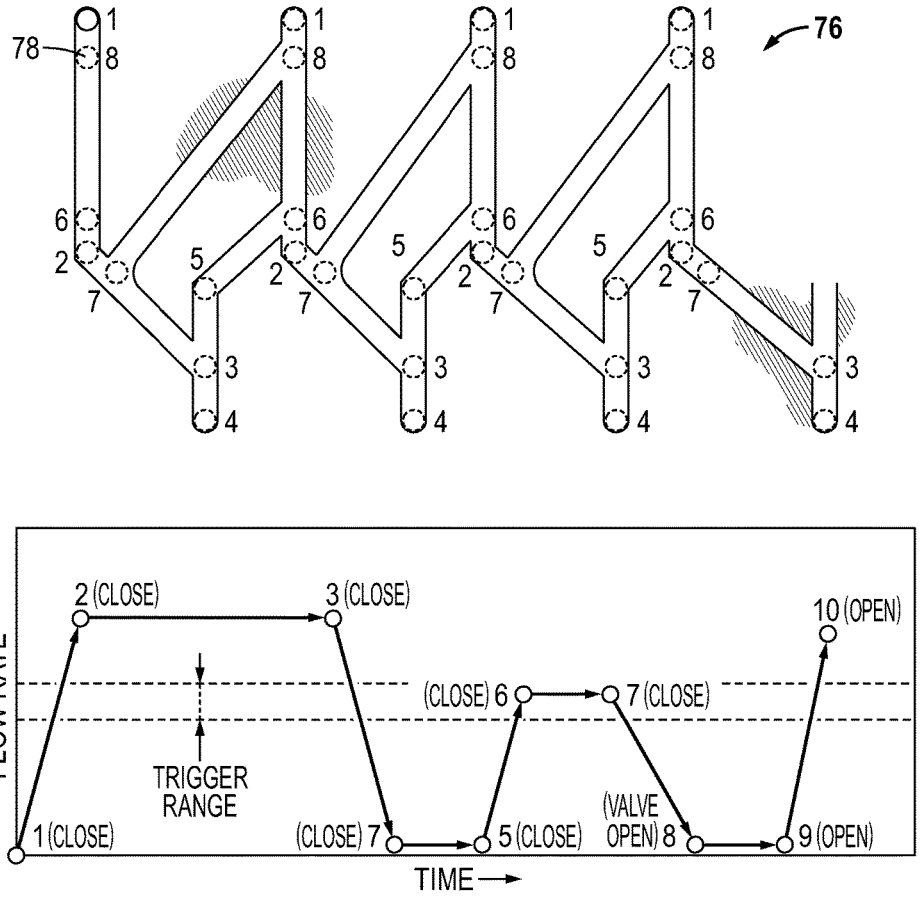
FIG. 17 is a schematic illustration of another example of a cam track which may be used to control an actuator during steering of a drilling assembly, according to an embodiment of the disclosure.

As illustrated in FIG. 17, cam track 76 may be arranged in a variety of other patterns, e.g. more complicated or sophisticated cam track patterns (see, for example, US Patent Application Publication: 2012/0199363). In this latter example, the position of the piston 30, e.g. either neutral mode position or bias mode position, may be selected by using a half flow indexing methodology, as illustrated.

Figure 18:
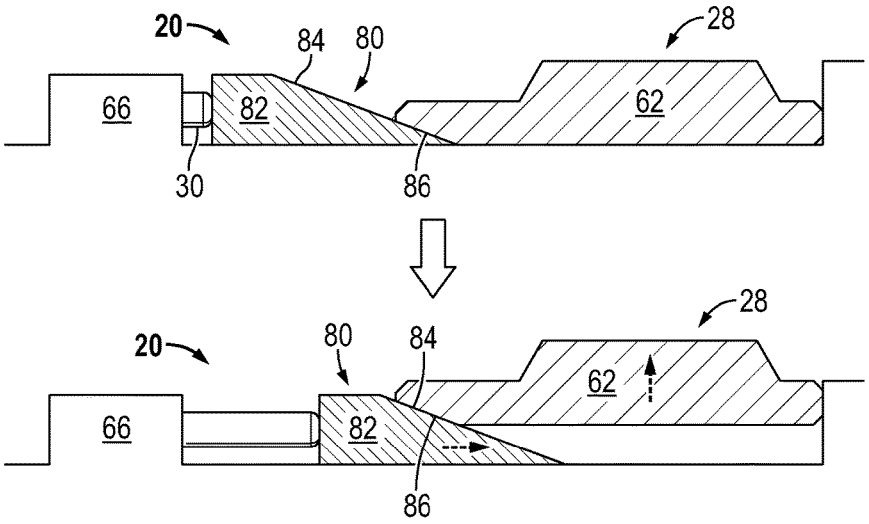
FIG. 18 is a schematic illustration of another example of the drilling system employing a ramp mechanism in two different operational positions, according to an embodiment of the disclosure.

The actuators 28 may comprise a variety of mechanisms for moving the shiftable stabilizer blades 62 or other steering mechanisms between operational positions. In the example illustrated in FIG. 18, the actuator 28 again comprises shiftable stabilizer blade 62 but the shiftable stabilizer blade 62 is moved between operational positions via a ramp mechanism 80. By way of example, the ramp mechanism 80 may comprise a ramp member 82 having an inclined ramp surface 84. The ramp member 82 may be coupled with piston 30 of actuation mechanism 66 or to another type of hydraulic piston or other actuator. For example, the actuation mechanism 66 may comprise a variety of other types of mechanisms, including hydro-mechanical mechanisms, electro-mechanical mechanisms, electric motors, drilling mud systems, and other types of mechanisms for moving the shiftable stabilizer blade 62 via ramp mechanism 80. In some embodiments, piston 30 is actuated downhole via, for example, control system 40.

As illustrated, the inclined ramp surface 84 is oriented for engagement with a corresponding inclined ramp surface 86 formed along the shiftable stabilizer blade 62. As the actuation mechanism 66 moves the ramp member 82 in a longitudinal direction toward shiftable stabilizer blade 62, the inclined ramp surface 84 moves against the corresponding inclined ramp surface 86 to force the shiftable stabilizer blade 62 from a retracted position (see upper portion of FIG. 18) to an extended or expanded position (see lower portion of FIG. 18). The ramp member 82 may be shifted away from stabilizer blade 62 when the stabilizer blade 62 is to be released from its expanded position.

In many applications, a surface operator, surface controller, and/or a downhole controller may be used to track the position of actuator 28, e.g. the position of shiftable stabilizer blade 62, so as to know whether the drilling system 20 is operating in a neutral (straight drilling) or sliding (deviated drilling) mode. The tracking of operational position may be accomplished according to various techniques, such as purely mechanical techniques or other techniques which utilize downhole markers, sensors, and/or electronics.

For purely mechanical tracking techniques, when the bias/slide mode is selected, some of the actuating fluid flow may be diverted to the annulus and/or to the drill bit nozzles. In this approach, the selection of the actuator extension position may be identified by monitoring a standpipe pressure at the surface. In another embodiment, an instrumented solution may be used for tracking. By way of example, magnets, e.g samarium-cobolt, high temperature magnets, may be placed inside the piston 30. A magnetometer or hall-effect sensor may be installed in a torquer (control unit) to pick up the magnetic field from the piston for calculation of the piston position. In this example, the torquer may be a microcontroller used to compute the piston position, and this position may be telemetered to the surface by a suitable telemetry system, such as an EM telemetry system and/or mud pulse telemetry system.

In other applications, more complicated instrumented solutions may be employed for tracking. Examples include deploying dedicated non-contact, proximity/distance sensor/markers. Examples of such sensors/markers comprise ultrasonic transducers, opto-electrical sensors, electro-mechanical switches, AC magnetic proximity sensors, and other suitable sensors. In these types of solutions, various wiring may be employed between the control unit in the torquer and the sensors.

If at least three independently controlled actuators 28, e.g shiftable stabilizer blades 62, are used, the tool face control during sliding mode may be controlled in a closed loop manner. For example, at least two transverse magnetometer sets and/or two transverse accelerometer sets may be used to detect magnetic and/or gravity tool face angles of the steering head of drilling system 20. The extension of the actuators 28/blade 62 may be continuously adjusted to control the tool face and its steering direction.

Figure 19:
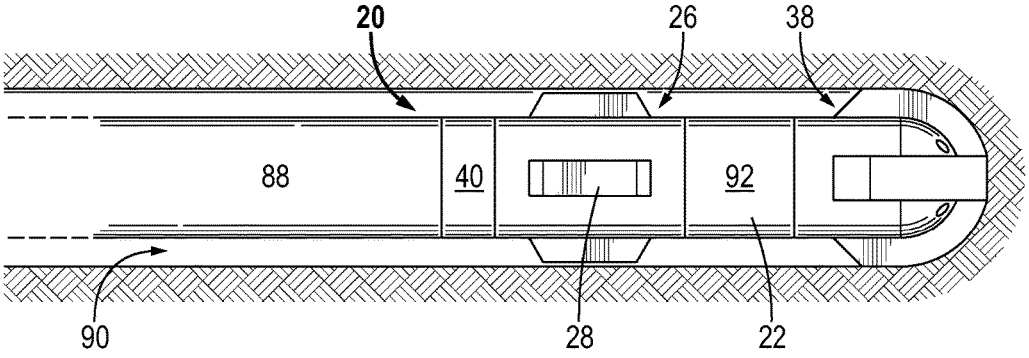
FIG. 19 is a schematic illustration of an example of a drilling system deployed along a drill string located in a borehole, according to an embodiment of the disclosure.

Referring generally to FIG. 19, an example of drilling system 20 is illustrated. In this example, the drilling system 20 is part of a drill string 88 deployed in a borehole 90. By controlling the rotational orientation of the drill string 88 and movement of actuator(s) 28 of structure 26, as described above, the borehole 90 may be drilled with desired straight sections and deviated sections extending in a desired direction. Depending on the application, control over the actuator 28 may be exercised by a downhole controller, a surface controller, or a combination of both downhole and surface control. Similarly, the drilling direction established by rotational control of drill string 88 may be determined according to a variety of surface controllers and/or other controllers provided at suitable locations. In some drilling applications, the structure/stabilizer 26 may be mounted about housing 22 of a positive displacement motor 92 as described above.

The embodiments described above facilitate a variety of drilling operations. However, the components of the drilling system may vary depending on the parameters of a given application and corresponding environment. Additionally, many types of actuators, pressurized fluid systems, tracking systems, and/or other systems may be combined with the drilling system to provide a relatively inexpensive and dependable system and technique for directional drilling. If, for example, drilling mud is used for actuating the stabilizer blades 62 or other actuators 28, the fluid may be supplied from various locations, e.g. from the top of the motor 44 via gun drilled holes or other passages.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for steering during drilling, comprising:

a drill string having a drilling system able to drill a straight section of a borehole along a straight borehole axis and able to drill a deviated section of the borehole, the drilling system comprising:

a bearing housing;

a bit shaft rotatably mounted in the bearing housing and having a bit shaft axis;

an actuator selectively shiftable between an unbiased mode in which the bit shaft axis is sufficiently aligned with the straight borehole axis to enable drilling of a straight section of the borehole and a biased mode in which the bit shaft axis is shifted off axis relative to the straight borehole axis to enable deviated drilling while the drill string is rotationally stationary; and a stabilizer disposed around the bearing housing, wherein the bearing housing comprises a housing of a positive displacement motor, further wherein the actuator comprises a piston disposed between the stabilizer and the bearing housing.

2. The system as recited in claim 1, further comprising a spring positioned between the stabilizer and the bearing housing to provide a bias against shifting of the bit shaft off axis.

3. The system as recited in claim 1, wherein the actuator comprises an extensible stabilizer blade.

4. The system as recited in claim 1, wherein the actuator comprises a plurality of actuators.

5. The system as recited in claim 1, further comprising a drill bit coupled to the bit shaft.

6. The system as recited in claim 1, wherein the actuator comprises a hydraulically shifted actuator.

7. The system as recited in claim 1, further comprising a control system having a hydraulic pump in fluid communication with the actuator via a hydraulic channel.

8. The system as recited in claim 7, wherein flow between the hydraulic pump and the actuator is automatically controlled via a sensor, a valve, and control electronics located downhole in the borehole.

9. A method for steering, comprising:

deploying a drilling system downhole, without a bent housing, via a drill string;

providing the drilling system with a drill bit coupled to a bit shaft rotatably mounted in a positive displacement motor housing for rotation about a bit axis;

positioning an actuator around the positive displacement motor housing;

drilling a straight borehole section along a straight drilling borehole axis while the drill string is rotated; and selectively shifting the actuator to move the bit axis of the bit shaft off the straight drilling borehole axis to enable drilling of a deviated borehole section while the drill string is held stationary at a desired rotational orientation, thus establishing a drilling direction.

10. The method as recited in claim 9, further comprising constructing the actuator with a stabilizer and orienting the actuator for lateral movement, wherein selectively shifting comprises shifting the bit axis of the bit shaft with respect to the stabilizer.

11. The method as recited in claim 9, wherein selectively shifting the actuator comprises hydraulically moving a piston.

12. The method as recited in claim 9, wherein selectively shifting comprises shifting the bit shaft off the straight drilling borehole axis by extending a blade of a stabilizer.

13. The method as recited in claim 9, wherein selectively shifting comprises shifting the bit shaft off the straight drilling borehole axis by extending a blade of a stabilizer via a ramp mechanism.

14. A method, comprising:

providing a drilling system along a drill string, the drilling system having a drill bit rotatable about a bit axis, a drill bit shaft coupled to the drill bit along the bit axis, the drill bit shaft being rotatably disposed in a positive displacement motor housing, and a stabilizer coupled to the positive displacement motor housing, the stabilizer being associated with an actuator movable in a radial direction;

establishing an unbiased orientation of the bit axis with respect to a straight borehole axis so the bit axis is generally aligned with the straight borehole axis during drilling of a straight borehole section; and selectively shifting the drill bit shaft and the drill bit by actuating the actuator via drilling mud, the actuator moving the bit axis to a biased orientation with respect to the straight borehole axis such that the bit axis is no longer generally aligned with the straight borehole axis, thus enabling drilling of a deviated borehole section while the drill string is held rotationally stationary.

15. The method as recited in claim 14, further comprising moving the actuator in a radially inward direction until the bit axis is aligned with the straight borehole axis and then rotating the drill string to drill another straight section of the borehole.

16. The method as recited in claim 15, further comprising using a control system located along the positive displacement motor housing, the control system receiving input from a sensor to control the position of the actuator and thus to control drilling of deviated borehole sections and straight borehole sections.

17. The method as recited in claim 14, further comprising forming the stabilizer with at least one radially extensible blade.

* * * * *